United States Patent [19]

Gomez et al.

[11] 4,103,135

[45] Jul. 25, 1978

[54] GAS OPERATED SWITCHES

[75] Inventors: Richard Santiago Gomez, Jericho; Eugene James Scray, Jr., Burlington, both of Vt.

[73] Assignee: International Business Machines Corporation, Armonk, N.Y.

[21] Appl. No.: 701,936

[22] Filed: Jul. 1, 1976

[51] Int. Cl.[2] ..... H01H 29/00

[52] U.S. Cl. ..... 200/185; 200/191; 335/47

[58] Field of Search ..... 200/182, 183, 184, 185, 200/186, 191, 192; 335/47–58

[56] References Cited

U.S. PATENT DOCUMENTS

| | | | |
|---|---|---|---|
| 1,598,874 | 9/1926 | Phelan | 200/235 |
| 2,666,105 | 1/1954 | Menozzi et al. | 200/191 X |
| 2,744,980 | 5/1956 | Bellamy | 200/191 |
| 2,802,918 | 8/1957 | Boyle | 200/183 X |
| 3,144,533 | 8/1964 | Donath | 200/235 |
| 3,176,101 | 3/1965 | Awender et al. | 200/191 |
| 3,646,490 | 2/1972 | Bitko | 200/234 |

FOREIGN PATENT DOCUMENTS

| | | | |
|---|---|---|---|
| 1,416,075 | 9/1965 | France | 200/191 |

*Primary Examiner*—Harold Tudor
*Attorney, Agent, or Firm*—Stephen J. Limanek

[57] ABSTRACT

Switches operated by gas, preferably controlled electrothermally, include a capillary tube closed at both ends with a conductive liquid piston dividing the tube into two chambers each filled with a non-oxidizing gas. A pair of electrical contact points are disposed within the capillary tube with the piston positioned to, at selected intervals, contact both points simultaneously. In one embodiment of the switches, a closed glass capillary tube contains a pair of aligned nickel wires with ends selectively contacted simultaneously by a mercury piston or globule providing a circuit-closing position for the switch. The switch is set in the circuit-closing position by applying heat to a non-oxidizing gas within one end of the capillary tube. The switch is then reset to a circuit-opening position at any desired time by applying heat to a non-oxidizing gas within the other end of the capillary tube. The non-oxidizing gas is heated by electrothermal means disposed at each end of and within the ends of the capillary tube. A barrier such as a collar disposed near the end of each of the wires is provided to prevent the mercury piston or globule from separating into a plurality of globules upon application of strong forces to the globule from either end of the tube.

24 Claims, 13 Drawing Figures

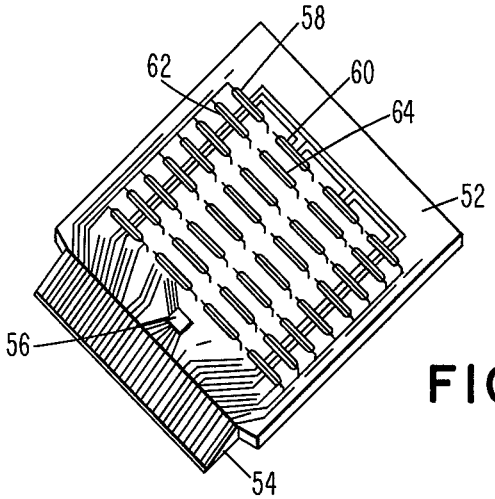
FIG. 10
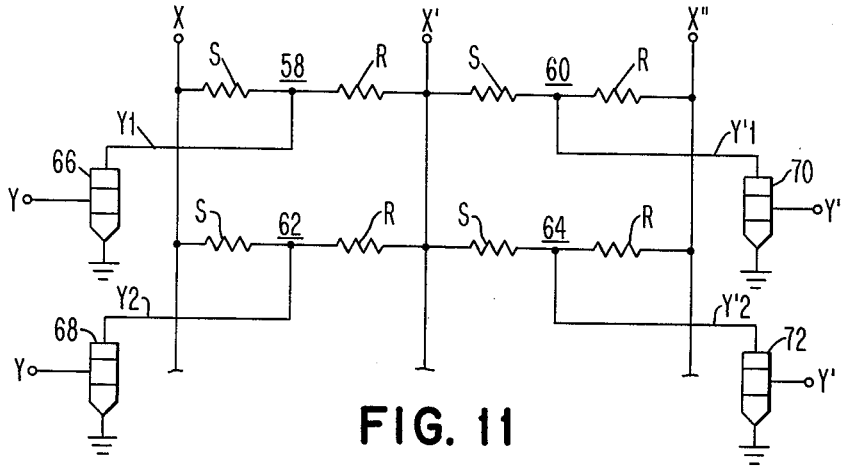
FIG. 11
| | | | | | Y | | Y' | |
|---|---|---|---|---|---|---|---|---|
| | | X | X' | X" | 1 | 2 | 1 | 2 |
| SW 58 | S | 1 | 0 | 0 | 1 | 0 | 0 | 0 |
| | R | 0 | 1 | 1 | 1 | 0 | 0 | 0 |
| SW 60 | S | 1 | 0 | 0 | 0 | 1 | 0 | 0 |
| | R | 0 | 1 | 1 | 0 | 1 | 0 | 0 |
| SW 62 | S | 0 | 0 | 1 | 0 | 0 | 1 | 0 |
| | R | 1 | 1 | 0 | 0 | 0 | 1 | 0 |
| SW 64 | S | 0 | 0 | 1 | 0 | 0 | 0 | 1 |
| | R | 1 | 1 | 0 | 0 | 0 | 0 | 1 |
FIG. 12
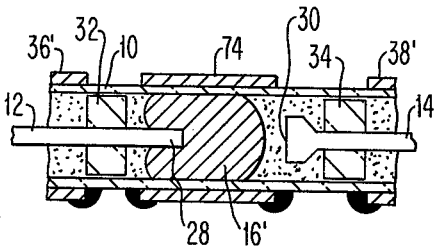
FIG. 13

GAS OPERATED SWITCHES

BACKGROUND OF THE INVENTION

1. Field of the Invention

This invention relates to mechanical switches for closing and opening electrical circuits. The switches may be set in a closed position for any desired period of time and then reset to an open position. More particularly the invention relates to gas operated conductive fluid switching devices for controlling the flow of current in electrical circuits.

2. Description of the Prior Art

Conductive fluid switching devices which are gas operated have been known for many years. These devices take various forms but each generally includes a capillary tube connected to one or more gas-filled bulbs having a diameter considerably larger than the diameter of the capillary tube. The gas in the gasfilled bulb is heated to provide pressure from one end of the capillary tube to urge the conductive fluid, generally mercury, toward the other end of the capillary tube.

U.S. Pat. No. 310,472 discloses an electrical switch including an enclosed glass tube having a pair of chamber sections united by a capillary passage containing a globule of mercury in which two wires, which may be made of platinum, are terminated. An electrical current producing heat expands the gas in the chamber forcing the globule of mercury through the capillary passage to control the operation of the switch. The heat may be generated by an electrical circuit within or outside of the chamber. U.S. Pat. No. 1,598,874 describes a switch comprising a closed container in which electrodes are sealed and at appropriate times brought into electrical conducting relation with one another through the agency of a body of highly pure mercury likewise contained in the container. The container may be filled with an inert gas such as nitrogen, helium or hydrogen. The electrodes may be made from the iron group, such as, iron, nickel and tungsten. U.S. Pat. No. 2,012,491 discloses a switch comprising a pair of hydrogen-filled chamber sections connected by a tubular section containing mercury. A heating element is disposed in each chamber section. The switch is operated as a latch by selectively immersing in the mercury first or second contacts depending upon which of the two heating elements is energized to expand the gas in its associated chamber section. U.S. Pat. No. 2,666,105 discloses a switch comprising a capillary tube coupled between two gasfilled chamber sections. Within the tube is a globule of mercury and a pair of wires contactable by the mercury. Heat produced in either of the two chamber sections alternately opens and closes the switch. In an embodiment of this switch, elongated metal bulbs of cylindrical shape are attached to the capillary tube and communicate therewith through a pair of spherical enlarged openings used to protect the metal from the mercury. U.S. Pat. No. 3,102,179 describes a switch comprising a capillary tube and a globule of mercury wherein a pair of stoppers are disposed within opposite ends of the capillary tube so as to prevent mercury from flowing out of the tube while providing passage of gas to the mercury. A wire and a glass thread are suggested as embodiments of the stopper. U.S. Pat. No. 3,176,101 discloses a switch comprising a capillary tube coupled between two gas-filled bulb-type chamber sections. Within the tube is a globule of mercury and a pair of wires contactable by the mercury. Electrical means are provided for each of the chamber sections for expanding the gas contained therein to move the mercury. Suggested heating means include a heating filament and a heating coil. U.S. Pat. No. 3,632,941 describes a switch comprising a globule of mercury movable within a cavity of substantially uniform cross-sectional area for selectively contacting the ends of a pair of wires by applying fluidic pressure alternately to opposite ends of the globule of mercury from first and second pressure sources. Means utilizing high surface tension of mercury are provided between the chamber in which the mercury moves and pressure sources to prevent the mercury from entering into the pressure sources.

The prior art conductive liquid or fluid switches, operate satisfactorily for their intended uses, but generally are expensive, bulky, slow, and shock, temperature and position sensitive.

SUMMARY OF THE INVENTION

An object of this invention is to provide an improved gas operated switch with a latching characteristic.

Another object of this invention is to provide an improved low cost switch which is bistable.

Yet a further object of this invention is to provide a miniature gas operated switch which switches at speeds substantially higher than known gas operated switches.

Still a further object of this invention is to provide a low cost switch by utilizing a unitary capillary tube closed at each of its ends.

Still another object of this invention is to provide a high speed, conductive fluid switching device which is substantially insensitive to shock.

These and other objects of the invention are attained by producing a gas operated switch which includes a unitary capilliary tube having closed ends. Disposed within the enclosed tube is a non-oxidizing gas separated into first and second chambers by a conductive liquid such as a globule or mercury. A pair of wires or electrical contacts are arranged so as to be simultaneously contacted by the mercury when the mercury is in a first position, while one or neither wire contacts the mercury when the mercury is in a second position. First and second heating means disposed in direct contact with the capillary tube for heating the gas in the first and second chambers, respectively, are energized to force the mercury into either the first or second position. To prevent the mercury from separating into a plurality of globules upon application of strong forces to the globule from either end of the tube, a barrier to the flow of mercury, such as an appropriate collar, but not to the flow of gas, is disposed within each of the first and second chambers.

The foregoing and other objects, features and advantages of the invention will be apparent from the following more particular description of the preferred embodiments of the invention, as illustrated in the accompanying drawings.

BRIEF DESCRIPTION OF THE DRAWINGS

In the drawings:

FIG. 10 illustrates a card assembly containing a plurality of switches of the present invention, FIG. 11 is a circuit diagram used to selectively energize the switches illustrated in the assembly of FIG. 10, FIG. 12 is a logic table used with the circuit diagram of FIG. 11 for selectively energizing the switches in FIG. 10, and FIG. 13 is another embodiment of the switch of the present invention which uses a solidifying liquid with a third heating means.

DESCRIPTION OF THE PREFERRED EMBODIMENTS

Figure 1:
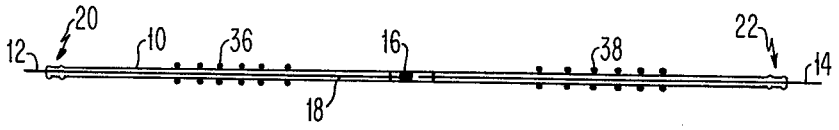
FIG. 1 illustrates, on an enlarged scale, one embodiment of the gas operated switch of the present invention.
Figure 2:
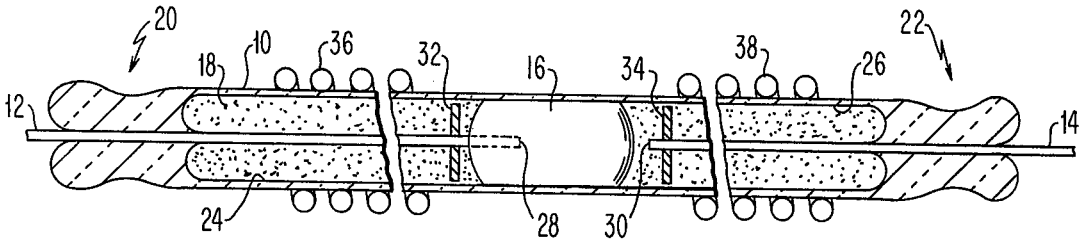
FIG. 2 is a further enlargement, with sections broken away, of the switch illustrated in FIG. 1.

Referring to the drawings now in more detail, there is shown in FIG. 1 and in FIG. 2, which is an enlarged view of FIG. 1, an embodiment of a switch of the present invention which includes a unitary capillary tube 10, preferably made of glass, first and second aligned electrical conductors 12 and 14, respectively, disposed within the tube 10 along with a globule of conductive liquid, preferably pure mercury 16, and a non-oxidizing gas 18. The capillary tube 10 is sealed at its ends 20 and 22 by collapsing the ends 20 and 22 around the conductors 12 and 14, respectively. The mercury 16 divides the sealed tube 10 into a first chamber 24 and a second chamber 26 having a volume substantially equal to that of the first chamber 24. Ends 28 and 30 of conductors 12 and 14, respectively, are disposed within the sealed tube 10 and terminate, in a spaced apart relationship with respect to each other, at or near the globule of mercury 16. The size of the globule of mercury 16 is such that it can be placed in contact with each of the conductor ends 28 and 30 simultaneously. A first barrier or collar 32 surrounds first electrical conductor 12 in the vicinity of its end 28 and a second barrier or collar 34 surrounds second electrical conductor 14 in the vicinity of its end 30. The collars 32 and 34, preferably made of glass or other material not wettable by the mercury 16, may be attached to conductors 12 and 14 and have a diameter such that the spacing between the collars 32 and 34 and the inside surface of tube 10 is less than 0.001 inches, preferably 0.0002 inches. The conductors 12 and 14, particularly ends 28 and 30, are made of a material, such as nickel, which is wettable by the mercury 16. The gas 18 may be nitrogen, hydrogen or freon. To provide a hermetic seal at the ends 20 and 22 of tube 10, conductors 12 and 14 are locally oxidized in the vicinity of the glass tube ends 20 and 22 and the glass tube ends 20 and 22 are heated and collapsed onto the oxidized conductor portions. First and second heating means, e.g., heating coils 36 and 38 made of nichrome or copper, are disposed in direct contact with the outside surface of tube 10 surrounding first and second chambers 24 and 26, respectively.

By forming the structure of the switch of the present invention as set forth hereinabove and as illustrated in FIGS. 1 and 2 of the drawing, a switch of very small size is produced. One switch which operated successfully had an outside tube diameter of 0.013 inches, an inside diameter of 0.007 inches and a length of 0.640 inches. The length of the seal at each end of the tube 10 was approximately 0.015 inches and the thickness of conductors 12 and 14 was 0.004 inches. The size of the mercury is approximately 0.007 by 0.014 inches.

In the operation of the switch, current from any convenient source is sent through heating coil 38 to place the switch in a reset or open position. As indicated more clearly in FIG. 2, when the switch is in its reset or open position, mercury 16 is in contact with the end 28 of conductor 12 but not in contact with the end 30 of conductor 14, thus current will now flow through the switch when a voltage differential is applied between conductors 12 and 14. To place the switch in a set or closed position current from any convenient source is sent through coil 36. When the switch is in its set or closed position mercury 16 simultaneously contacts the conductor ends 28 and 30.

It should be noted that tube 10 having a uniform diameter as a capillary tube from end 20 to end 22, not only is simple to fabricate but also provides a large heating surface to the gas in chambers 24 and 26 while cooling rapidly after the current in the coils 36 and 38 is turned off. High speed repetitive switching of gas operated switches requires the rapid thermal response of the gas in chambers 24 and 26. This arrangement, therefore, provides significant differential pressures between the free ends of mercury thereby enhancing switching speed and action. It should also be noted that by utilizing a uniform capillary tube diameter through the entire switch, the walls of the tube 10 may be made thin, e.g., 0.003 inches or less, without resorting to costly manufacturing processes. The thin wall of tube 10 rapidly transmits the heat from the coil 36 or 38 to its respective chamber, causing the gas to expand and drive the mercury 16 toward the other chamber. Since the other chamber is very thin and elongated, its temperature and that of the gas contained therein remains at virtually the ambient temperature when its heating means is not energized.

Since this switch is designed to operate at a very high speed, e.g., at a response time of less than 25 milliseconds, a thermal shock, i.e., a pulse of heat of less than 10 milliseconds duration, can be utilized when the necessary energy in milliwatt seconds is delivered in this time. To insure the integrity of the globule of mercury 16 as a single globule, the collars 32 and 34 are arranged adjacent to the reciprocating path of the mercury near the ends 28 and 30 of the conductors 12 and 14. The collars 32 and 34 as well as the conductors 12 and 14 at the collars should have non-wetting surfaces. The mercury piston displacement and/or smaller globules that can be produced by mechanical shock are, therefore, confined within a volume bounded by the collars. Small globules, therefore, cannot exist since their confinement increases the probability of globules intercontacting with each other. The intercontacting of globules will cause instantaneous absorption of the smaller globule by the larger unit.

Figure 3:
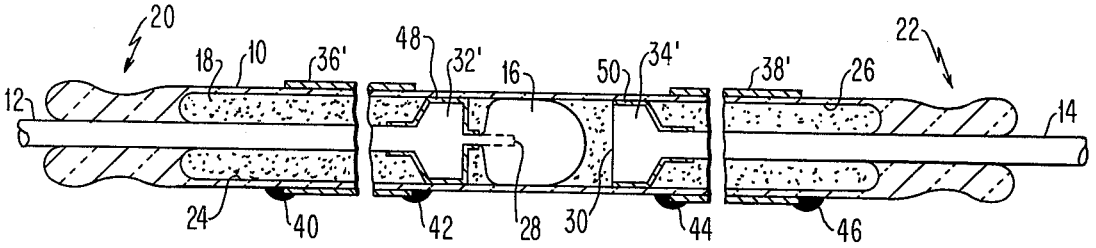
FIG. 3 is an enlarged view, with sections broken away, of another embodiment of the switch of the present invention.

FIG. 3 illustrates another embodiment of the switch of the present invention. This embodiment of the switch is shown in FIG. 3 in an enlarged view similar to the view of the switch illustrated in FIG. 2, and similar elements of the switches are indicated by similar reference numbers. The switch of FIG. 3 differs from the switch of FIG. 2 in that the heating means for chambers 24 and 26 are in the form of resistive films 36' and 38', respectively. Current supply terminals 40 and 42 are provided for resistive film 36' and current supply terminals 44 and 46 are provided for resistive film 38'. These films 36' and 38' may be made of carbon and glass which is painted, sprayed or evaporated onto the tube 10. The switch of FIG. 3 also differs from the switch of FIG. 2 in that barriers or collars 32' and 34' are provided as an integral portion of the conductors 12 and 14, respectively. These collars 32' and 34' are also arranged so that the spacing between the collars 32' and 34' and the inside surface of tube 10 is less than 0.001 inches so as to prevent the mercury 16 from passing therethrough while permitting the passage of the inert gas 18. Since the conductors 12 and 14 are made of a wettable material such as nickel, a coating of nonwettable material such as a layer of chrome 48 and 50 is provided over each of the barriers or collars 32' and 34', respectively. As indicated in FIG. 3, the end 28 of conductor 12 is free of chrome, as is the vertical surface of the end 30 of conductor 14. The switch of FIG. 3 operates in a manner similar to that described in connection with the switch of FIG. 2.

Figure 4:
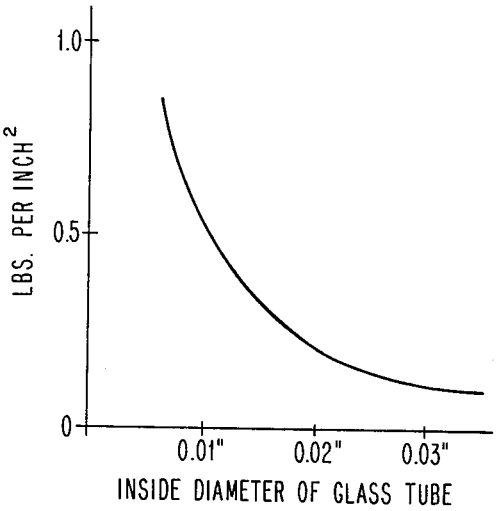
FIG. 4 is a graph indicating the increase in hysteresis with decrease in diameter of the bore of a capillary tube.

In FIG. 4 there is shown a graph indicating the change in the force required to move the globule of mercury 16 as the inside diameter of the capillary tube 10 decreases. From an observation of the graph, it can be seen that the required force increases rapidly in a non-linear manner as the inside tube diameter decreases. Thus, the hysteresis or retardation effect caused by the globule of mercury 16 within the capillary tube 10 increases rapidly with a decrease in tube diameter.

Figure 5:
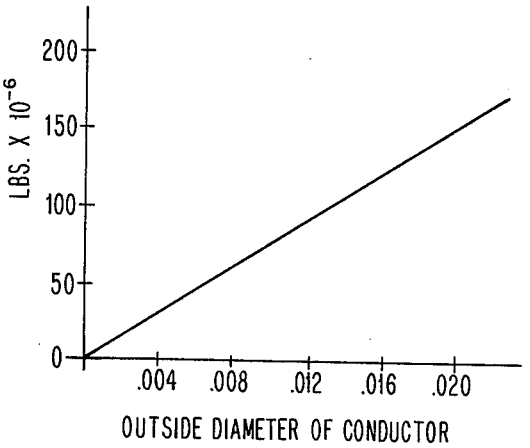
FIG. 5 is a graph indicating the increase in force between a mercury film and a wire or conductor with increase in the outside diameter of the wire or conductor, FIG. 6 indicates the switching action of the switch of FIG. 3 when it begins to close, FIG. 7 indicates the switching action as in FIG. 6 but with the switch in its closed position, FIG. 8 indicates the switching action of the closed switch when it begins to open, FIG. 9 indicates the switching action as in FIG. 8 but as the switch opens.

In FIG. 5 there is shown a graph indicating the change in force between a film of mercury and the outside diameter of a wire or conductor to which the mercury adheres. It can be seen that the adhering force linearly increases with the outside diameter of the wire or conductor.

It should be noted that the switch of this invention has a very strong latching action, since the capillary tube is constructed with a very small inside diameter and conductor 14 has a large outside diameter at its end 30 to provide an additional force when the switch is in its set or closed position.

Figure 6:
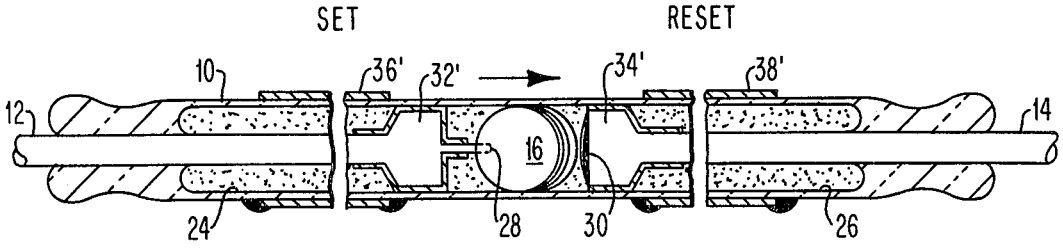
Figure 7:
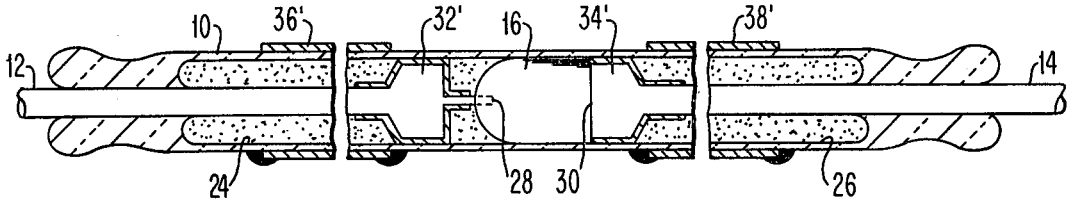
Figure 8:
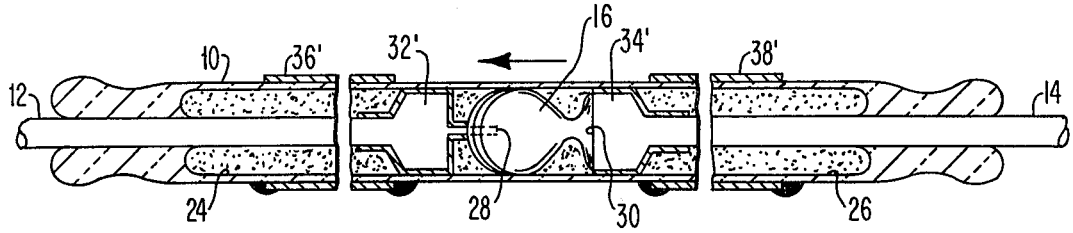
Figure 9:
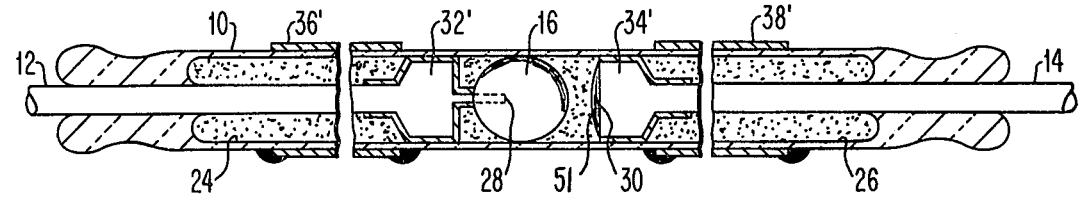

FIGS. 6 and 7 indicate the switching action of the switch illustrated in FIG. 3 of the drawings as the switch is being closed. To initiate this switching action, the heating means 36' is energized to heat and thus expand the gas in the first chamber 24. The force created by the expanding gas is directed to the mercury 16 via the gap formed between the collar 32' and the inside surface of tube 10 to move the mercury 16, acting as a piston, toward the end 30 of the conductor 14, as indicated in FIG. 6. In FIG. 7, the switch is shown in its closed position with the mercury 16 in intimate contact with end 30 of conductor 14 while the mercury 16 continues to maintain contact with the end 28 of conductor 12. As soon as the switch is closed the heating means 36' is de-energized and due to the long thin structure forming chamber 24, the gas 18 is chamber 24 cools rapidly, decreasing the pressure on the free end of the mercury in chamber 24. Due to this rapid decrease in pressure in chamber 24, the switch can be quickly reset or opened by energizing the heating means 38' which expands the gas in the second chamber 26. The force created by the expanding gas is directed to the mercury 16 via the gap formed between the collar 34' and the inside surface of tube 10 to move the globule of mercury 16 toward the end 28 of the conductor 12. The de-energization of the heating means is permissible prior to switch closer if sufficient total energy has been delivered to quarantee switch closure. In FIG. 8 of the drawing, the switching action is indicated as the switch begins to open and in FIG. 9 the switch is shown in its open position. It should be noted that a small amount of mercury 51 adheres to the end 30 of conductor 14 as the main body of the globule of mercury 16 returns to the open position of the switch. It has been found that only a small fixed amount of the mercury remains on the end 30 of conductor 14 to form a film and that this film provides a very desirable wetting action with the main body of mercury 16.

In FIG. 10 of the drawings there is shown a card assembly which contains a plurality of the switches illustrated, e.g., in FIGS. 1, 2 and 3 of the drawings. Although 32 switches, or 16 pairs of switches, are indicated, more or fewer switches may be contained in any card, as desired. In view of the extremely small size and construction, the switches may be solder reflowed or wire bonded to the card enabling hundreds of switches to be readily assembled in a single card. The card includes a substrate 52 and an input/output terminal board 54 to which the switches are connected. A semiconductor integrated circuit chip 56, in which may be formed one or more transistors, is mounted on the substrate 52 for controlling the operation of the switches. A control circuit shown in FIG. 11 of the drawing may be used to control, e.g., switches 58, 60, 62 and 64 indicated in FIG. 10 of the drawing. Of course, additional switches in the card assembly of FIG. 10 may be controlled by expanding the control circuit of FIG. 11. A logic table which may be used with the control circuit of FIG. 11 is shown in FIG. 12 of the drawings. It can be seen from FIGS. 10, 11 and 12, that when a pulse indicated by a 1 or a ground indicated by a 0 in the table of FIG. 12 are appropriately applied to the X, X', X'', Y and Y' terminals of FIG. 11, any of the switches 58, 60, 62 and 64 may be set or reset as desired. In FIG. 11, coils S and R represent the heating means such as 36' and 38', respectively, for switches 58, 60, 62 and 64, as indicated. Transistors 66, 68, 70 and 72 may be formed in integrated circuit chip 56 of FIG. 10. The individual or pairs of switches in the card assembly of FIG. 10 may be used to control any desired electrical circuits, such as those found in telephone switching exchanges.

In FIG. 13 there is illustrated still another embodiment of the switch of the present invention. In the switch of FIG. 13, shown in an enlarged view with the ends of the tube 10 omitted, the globule of conductive liquid is preferably a globule of solder or indium 16'. The switch operates in substantially the same manner as do the switches of the present invention described hereinabove, except that a third heating means 74 is provided to maintain the globule 16' in its liquid state. By utilizing the solder or indium globule, there is a further improvement in the shock sensitivity of the switch of the present invention. This switch permits half select or partial selection driver logic to reduce driver requirements when the switch is used in areas requiring massive X, Y selection, e.g., large cross bars.

Activation of the switch requires the selective application of energy to heating means 36', 74 and 38' in FIG. 13. It can be seen that if heating means 74 is not energized a change in switching will not take place, nor will a change in the switching action occur if heating means 36', 74 and 38' are energized simultaneously. To set or close the switch, only heating means 36' and 74 are energized and to reset or open the switch only heating means 74 and 38' are energized. It should be noted that the liquid-solid switch of FIG. 13 can be used in many applications where extreme shock is encountered.

Although the invention has been illustrated as having heating coils or films for expanding the gas 18, it should be understood that other heating means such as radiant energy from a laser beam may be desired for some applications of the switch of the present invention. Furthermore, it should be understood that the heating means may be embedded in the wall of the glass capillary tube and may be formed therein as a resistive glass. Also, if desired, the heating means may be disposed within the capillary tube along its length within the chambers 24 and 26.

While the invention has been particularly shown and described with reference to preferred embodiments thereof, it will be understood by those skilled in the art that various changes in form and details may be made therein without departing from the spirit and scope of the invention.

What is claimed is:

1. A switch comprising a capillary tube having first and second ends and a substantially uniform internal diameter between said ends, said ends being closed to form a hermetically sealed chamber within said tube, a non-oxidizing gas disposed within said chamber, a pair of electrical conductors, each having a contact point disposed within said chamber, a globule of conductive liquid disposed within said chamber so as to form first and second compartments containing said gas, first and second barrier members disposed within said first and second compartments, respectively, in the vicinity of said globule of conductive liquid so as to confine said globule within a predetermined volume, and means disposed between said first and second ends of said capillary tube for heating said gas in said first and second compartments to position at selected intervals said globule of liquid in contact with the contact points of said pair of conductors simultaneously.

2. A switch as set forth in claim 1 wherein said capillary tube is a unitary tube made of electrically non-conducting material.

3. A switch as set forth in claim 1 wherein said heating means includes first and second heaters disposed in contact with said first and second gas compartments.

4. A switch as set forth in claim 3 wherein said heating means further includes a third heater disposed so as to selectively heat said globule of conductive liquid.

5. A switch as set forth in claim 4 wherein said globule of liquid solidifies at ambient temperature.

6. A switch as set forth in claim 5 wherein said globule of liquid is solder or indium.

7. A switch as set forth in claim 3 wherein said heaters include resistive films in contact with said capillary tube.

8. A switch as set forth in claim 3 further including means for alternately energizing said first and second heaters so as to position said globule of conductive liquid in switch closing and switch opening positions, respectively.

9. A switch as set forth in claim 1 wherein said first and second barrier members each include a nonwettable collar suurrounding said pair of electrical conductors.

10. A switch as set forth in claim 9 wherein said globule of conductive liquid is mercury and said collars are made of glass.

11. A switch as set forth in claim 9 wherein said nonwettable collars are integral with said pair of electrical conductors and include a coating of nonwettable material.

12. A switch as set forth in claim 11 wherein said pair of electrical conductors are made of nickel, said coating of non-wettable material is chrome and said globule of conductive liquid is mercury.

13. A switch as set forth in claim 12 wherein said capillary tube is made of glass and has a substantially uniform inside diameter of less than about 0.010 inches.

14. A switch as set forth in claim 13 wherein said pair of electrical conductors include a first conductor disposed in said first compartment along the axis of said tube and a second conductor disposed in said second compartment along the axis of said tube, said contact points being respective ends of said first and second conductors contactable by said globule of mercury.

15. A switch as set forth in claim 14 wherein the contact point of said first conductor has a given cross-sectional area and is positioned to permanently contact said globule of mercury and the contact point of said second conductor has an area substantially larger than said given cross-sectional area with a diameter substantially equal to but less than the inside diameter of said capillary tube.

16. A switch as set forth in claim 9 wherein said first and second barrier members are spaced from the inside surface of said capillary tube to permit the flow of said gas between said first and second barriers and said tube.

17. A switch as set forth in claim 1 wherein said pair of electrical conductors include a first conductor disposed in said first compartment along the axis of said tube and a second conductor disposed in said second compartment along the axis of said tube, and wherein said ends of said capillary tube are in intimate contact with said first and second conductors to form said hermetically sealed chamber.

18. A switch comprising:

a unitary capillary tube having first and second closed ends and made of electrically non-conducting material forming an elongated chamber, said tube having a substantially uniform cross-section along the axis of said tube between said ends, first and second conductive members each having one end disposed within said chamber, first, second and third fluids disposed within said chamber, said first fluid being conductive and at least one of said second and third fluids being insulative, said first fluid being disposed further so as to isolate said second and third fluids from each other, means disposed within each of said second and third fluids for preventing said first fluid from passing therethrough while permitting said fluid in which each of said means is disposed to pass therethrough, and means disposed between the first and second ends of said capillary tube for controlling the pressure exerted by said second and third fluids against said first fluid so as to selectively move said first fluid into and out of simultaneous contact with said one ends of said first and second conductive members.

19. A switch as set forth in claim 18 wherein said pressure controlling means includes electrical heating means.

20. A switch as set forth in claim 18 wherein said first fluid is mercury.

21. A switch as set forth in claim 20 wherein said second and third fluids include a non-oxidizing gas.

22. A switch as set forth in claim 18 wherein said preventing means are first and second collars, each of said collars being disposed between a respective one of said conductive members and said tube.

23. A switch as set forth in claim 18 wherein said first and second conductive members are wires, aligned, spaced apart and passing through opposite ends of said tube.

24. A switch as set forth in claim 19 wherein said electrical heating means are electrical resistance heating means.

* * * * *